US008939688B2

(12) United States Patent
Fell

(10) Patent No.: US 8,939,688 B2
(45) Date of Patent: Jan. 27, 2015

(54) WEIGHT RELIEF TRANSPORTATION APPARATUS FOR CONSTRUCTION EQUIPMENT

(75) Inventor: Randall O. Fell, Campbellsport, WI (US)

(73) Assignee: Marriott Construction, Inc., Waukesha, WI (US)

( * ) Notice: Subject to any disclaimer, the term of this patent is extended or adjusted under 35 U.S.C. 154(b) by 520 days.

(21) Appl. No.: 13/277,857

(22) Filed: Oct. 20, 2011

(65) Prior Publication Data

US 2013/0101381 A1 Apr. 25, 2013

(51) Int. Cl.

| | |
|---|---|
| ***B65D 19/38*** | (2006.01) |
| ***B65D 19/22*** | (2006.01) |
| ***B65G 67/02*** | (2006.01) |
| ***B65D 19/44*** | (2006.01) |

(52) U.S. Cl.

CPC ..... *B65D 19/38* (2013.01); *B65D 19/44* (2013.01)

USPC ..... 410/80; 414/800; 248/346.02; 108/55.3

(58) Field of Classification Search

USPC ..... 410/80, 87, 3, 30; 404/112; 414/456, 414/451.3, 910, 911, 800, 234, 252, 452, 414/451.4; 248/346.02, 551, 509; 206/335, 206/807

See application file for complete search history.

(56) References Cited

U.S. PATENT DOCUMENTS

| | | | | |
|---|---|---|---|---|
| 2,804,253 | A * | 8/1957 | Brandt | 206/320 |
| 2,936,985 | A | 5/1960 | Doerr et al. | |
| 2,956,763 | A | 10/1960 | D'Arca | |
| 3,620,388 | A | 11/1971 | Mansson | |
| 3,949,878 | A | 4/1976 | Doane | |
| 4,747,495 | A | 5/1988 | Hoss | |
| 4,804,087 | A * | 2/1989 | Smith | 206/335 |
| 5,497,708 | A | 3/1996 | Jeruzal | |
| 5,505,140 | A | 4/1996 | Wittmann | |
| 5,593,259 | A | 1/1997 | Kuo | |
| 5,664,394 | A | 9/1997 | Sweeney | |
| 5,755,472 | A | 5/1998 | Clive-Smith | |

(Continued)

FOREIGN PATENT DOCUMENTS

| | | |
|---|---|---|
| DE | 20000157 | 7/2000 |
| JP | 6156495 | 6/1994 |

(Continued)

OTHER PUBLICATIONS

International Search Report and Written Opinion for Application No. PCT/US2011/057113 dated Jul. 30, 2012 (12 pages).

(Continued)

*Primary Examiner* — Glenn Dayoan
*Assistant Examiner* — Sunsurraye Westbrook
(74) *Attorney, Agent, or Firm* — Michael Best & Friedrich LLP

(57) ABSTRACT

A transportation system for transporting construction equipment that rides on a driven element during ordinary operation. The transportation system relieves a portion or all of the operational weight of the construction equipment from the driven element during transportation of the construction equipment. The transportation system includes a frame, upwardly extending supports that support a chassis of the construction equipment, and a lifting device interface for loading and unloading the transportation system with respect to a vehicle or trailer for transporting the construction equipment.

22 Claims, 8 Drawing Sheets

(56) References Cited

U.S. PATENT DOCUMENTS

| | | | | |
|---|---|---|---|---|
| 5,787,817 | A | 8/1998 | Heil | |
| 5,911,179 | A | 6/1999 | Spiczka | |
| 5,970,886 | A | 10/1999 | Knio | |
| 6,606,784 | B1 | 8/2003 | Huff et al. | |
| 6,769,368 | B2 | 8/2004 | Underbrink et al. | |
| 7,021,461 | B1 | 4/2006 | Robey | |
| 7,077,067 | B2 | 7/2006 | Bodde et al. | |
| 7,077,374 | B1 | 7/2006 | Johnson | |
| 7,438,195 | B2 * | 10/2008 | Beck | 211/194 |
| 7,648,026 | B2 | 1/2010 | Brittain | |
| 7,845,894 | B2 | 12/2010 | Dickinson et al. | |
| 7,946,458 | B2 | 5/2011 | Joseph | |
| 2006/0204336 | A1 * | 9/2006 | Masterson et al. | 404/112 |
| 2008/0219765 | A1 * | 9/2008 | Rose | 404/75 |
| 2009/0050031 | A1 | 2/2009 | Cai | |
| 2009/0267280 | A1 | 10/2009 | Lauzier et al. | |
| 2009/0274517 | A1 * | 11/2009 | Rose | 404/112 |

FOREIGN PATENT DOCUMENTS

| | | |
|---|---|---|
| JP | 2008239170 | 10/2008 |
| JP | 2011121633 | 6/2011 |

OTHER PUBLICATIONS

Transmittal of the International Preliminary Report on Patentability from the International Preliminary Examining Authority for Application No. PCT/US2011/057113 dated Sep. 19, 2013 (21 pages).

* cited by examiner

WEIGHT RELIEF TRANSPORTATION APPARATUS FOR CONSTRUCTION EQUIPMENT

BACKGROUND

The present invention relates to a transportation system or transportation rack for supporting construction equipment during transportation of the construction equipment. One exemplary application is for the support of power concrete trowels during transportation.

SUMMARY

In one embodiment, the invention provides a transportation system for construction equipment that includes a chassis, a prime mover supported by the chassis, and a driven element, the construction equipment having an operational weight that is borne by the driven element during ordinary operation of the construction equipment, the driven element adapted to be actuated under the influence of the prime mover during operation of the construction equipment to perform work, the transportation system comprising: a frame; and a plurality of supports mounted to the frame, the supports adapted to receive a portion of the construction equipment chassis and support at least a portion of the operational weight; wherein the transportation system is adapted to be loaded on a transporter for transportation of the construction equipment.

In some embodiments, the frame is generally horizontal; and wherein each of the supports extends upwardly. In some embodiments, the supports are adapted to support the entire operational weight such that the driven element bears none of the operational weight during transportation. In some embodiments, each support includes a channel member that opens upwardly to receive a portion of the construction equipment chassis; wherein the channel members support the construction equipment and limit horizontal movement of the construction equipment with respect to the frame during transport. In some embodiments, the channel members are generally U-shaped.

In some embodiments, the transportation system further comprises a gate associated with each channel member, the gate being movable between an open position in which the gate opens the channel member to permit loading of a portion of the chassis into the channel member, and a closed position in which the gate closes the channel member to capture the portion of the chassis member within the channel member and limit vertical movement of the construction equipment with respect to the frame during transport. In some embodiments, each channel member includes a pair of holes; the transportation system further comprising a pin removable from at least one of the holes to open the channel member to permit loading of a portion of the chassis into the channel member, and insertable into both holes to close the channel member to capture the portion of the chassis member within the channel member and limit vertical movement of the construction equipment with respect to the frame during transport.

In some embodiments, the transportation system further comprises comprising a lifting device interface mounted to the frame and adapted to receive portions of a lifting device to facilitate loading and unloading the transportation system onto and off of the transporter with the lifting device. In some embodiments, the transportation system further comprises a pair of tubes extending under the frame, the tubes being rigidly affixed to the frame and facilitating lifting of the transportation system with a lifting device; at least one inner brace member rigidly affixed to each of the tubes; and at least one outer brace member rigidly affixed to one of the tubes and to the frame.

The invention also provides a method of transporting construction equipment, comprising: providing construction equipment that includes a chassis, a prime mover supported by the chassis, and a driven element, the construction equipment having an operational weight that is borne by the driven element during ordinary operation of the construction equipment, the driven element adapted to be actuated under the influence of the prime mover during operation of the construction equipment to perform work; providing a transportation rack that includes a frame and a plurality of supports mounted to the frame; positioning the construction equipment on the rack with each of the supports receiving a portion of the construction equipment chassis; bearing with the supports at least a portion of the operational weight; loading the rack bearing the construction equipment on a transporter for transportation of the construction equipment; and transporting the construction equipment with the transporter to a desired location.

In some embodiments, providing a transportation rack includes extending the supports upwardly from the frame. In some embodiments, bearing at least a portion of the operational weight includes bearing the entire operational weight such that the driven element bears none of the operational weight during transportation.

In some embodiments, the method further comprises generating dynamic loading on the rack and construction equipment in response to transporting the construction equipment; and accommodating with the configuration of the supports an expected range of movement of the driven element in response to the dynamic loading to protect the driven element from potentially damaging impact loading.

In some embodiments, providing a transportation rack includes providing a channel member as part of each support, each channel member opening upwardly to receive a portion of the chassis; wherein positioning the construction equipment on the rack includes positioning a portion of the chassis in each of the channel members; and wherein transporting the construction equipment includes resisting with the channel members horizontal movement of the construction equipment with respect to the frame. In some embodiments, providing a transportation rack includes providing a gate associated with each channel member; wherein positioning the construction equipment on the rack includes moving the gate into an open position to permit loading of a portion of the chassis into the channel member and moving the gate into a closed position to capture the portion of the chassis member within the channel member; and wherein moving the gate into a closed position includes resisting with the gate horizontal vertical movement of the construction equipment with respect to the frame. In some embodiments, providing a transportation rack includes mounting a lifting device interface to the frame; and wherein loading the rack bearing the construction equipment on a transporter includes engaging the lifting device interface with a lifting device and loading the rack and construction equipment onto the transporter with the lifting device.

The invention also provides a method of transporting a power trowel, comprising: providing a power trowel that includes a chassis, a prime mover supported by the chassis, and plurality of trowel blades, the power trowel having an operational weight that is borne by the trowel blades during ordinary operation of the construction equipment, the trowel blades adapted to be actuated under the influence of the prime mover during operation of the power trowel to smooth concrete; providing a transportation rack that includes a frame and a plurality of supports mounted to the frame; positioning the power trowel on the rack with each of the supports receiving a portion of the chassis; bearing with the supports at least a portion of the operational weight such that such portion of the operational weight is not borne by the trowel blades; loading the rack bearing the power trowel on a transporter; and transporting the power trowel with the transporter to a desired location.

In some embodiments, providing a power trowel includes providing a power trowel with a chassis that includes a skirt having a bottom edge, the trowel blades rotating below the skirt under the influence of the prime mover; and wherein positioning the construction equipment on the rack includes resting the bottom edge on the supports. In some embodiments, providing a power trowel includes providing a walk-behind trowel, a portion of the chassis defining a circular bottom edge around the trowel blades; wherein providing a transportation rack includes arranging the supports in a circular configuration; and wherein positioning the construction equipment on the rack includes resting the circular bottom edge on the supports. In some embodiments, providing a power trowel includes providing a ride-on trowel having multiple sets of trowel blades, a portion of the chassis defining multiple curved portions; wherein providing a transportation rack includes arranging the supports in a configuration that mirrors the multiple curved portions; and wherein positioning the construction equipment on the rack includes resting the multiple curved portions on the supports. In some embodiments, bearing at least a portion of the operational weight includes distributing the borne operational weight evenly among the plurality of supports.

In some embodiments, the method further comprises providing a securing apparatus; securing the frame to the transporter with the securing apparatus by applying a securing load to the frame a long a load path; and positioning the power trowel outside of the load path such that the power trowel bears none of the securing load.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

The present invention provides a transportation rack or system for construction equipment. The construction equipment includes a chassis, a prime mover supported by the chassis, and a driven element. The driven element is actuated under the influence of the prime mover during operation of the construction equipment to perform work. The construction equipment has an operational weight that is borne by the driven element during ordinary operation of the construction equipment.

Figure 1:
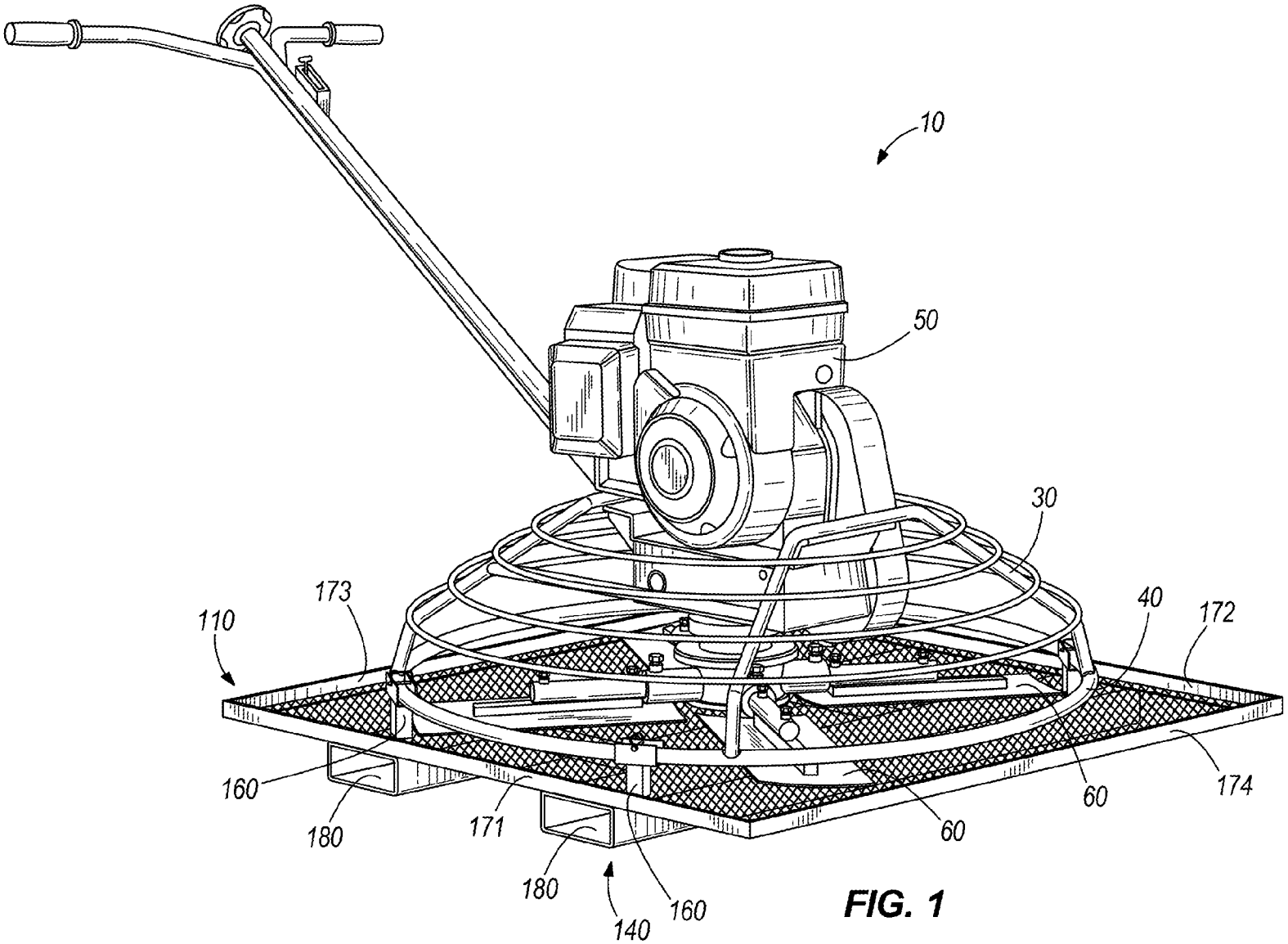
FIG. 1 is a perspective view of a transportation rack according to a first embodiment of the present invention, bearing a piece of construction equipment.
Figure 6:
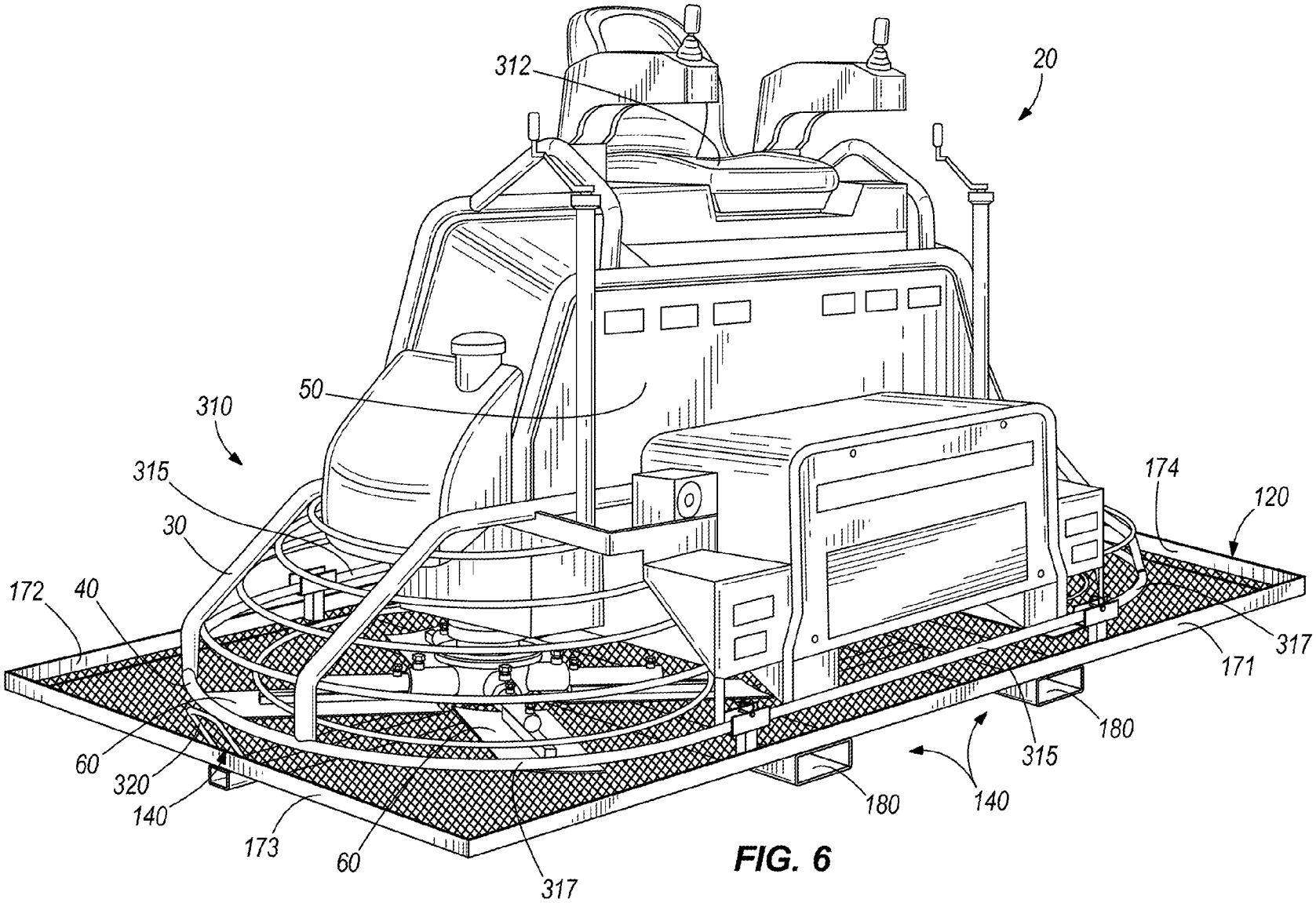
FIG. 6 is a perspective view of a transportation rack according to a second embodiment of the present invention, bearing another piece of construction equipment.
Figure 9:
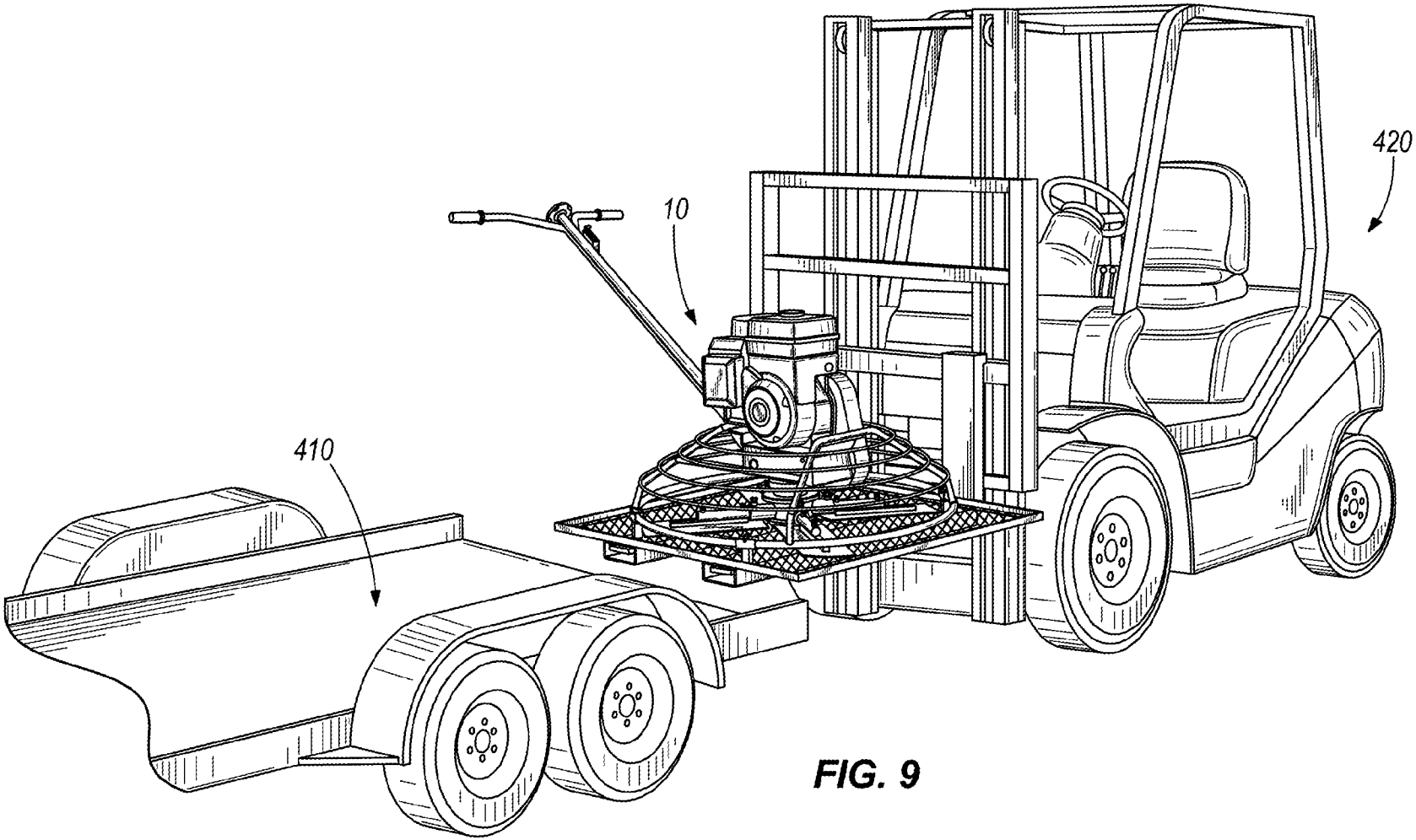
FIG. 9 illustrates a lifting apparatus lifting the transportation rack and construction equipment for deposit into a transporter.

One example of a piece of construction equipment for use with the transportation system or transportation rack is a walk-behind trowel 10 as illustrated in FIGS. 1 and 9. Another example is a ride-on trowel 20 as illustrated in FIG. 6. Although the walk-behind trowel 10 and ride-on trowel 20 are different sizes, the basic components discussed in this specification are similar and will be identified with the same reference numerals in the drawings. In these illustrated embodiments, the chassis includes a skirt 30 having a bottom rim 40. The prime mover is a gasoline-powered internal combustion engine 50. In other embodiments, the prime mover may be an electric motor or other type of motor, and the invention should not be limited to the gasoline powered internal combustion engine illustrated. The driven element includes the trowel blades 60.

The trowel blades 60 rotate under the bottom rim 40 of the skirt 30, under the influence of the engine 50. As the trowel blades 60 rotate, they smooth or polish the concrete over which the trowel 10, 20 travels. The trowel blades 60 carry the entire operational weight of the trowel 10, 20. The operational weight is the entire weight of all components of the trowel 10, in its ordinary operating configuration and environment. In the case of the ride-on trowel 20, the operational weight includes the weight of an operator seated on the trowel 20.

Figure 2:
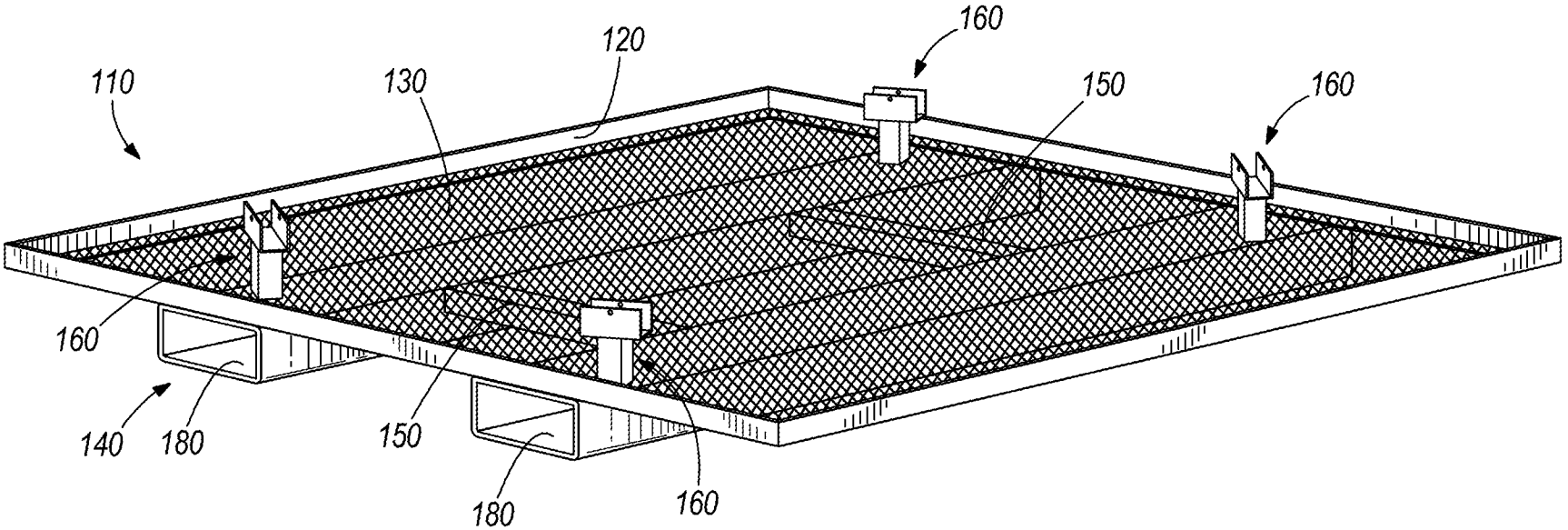
FIG. 2 is a perspective view of the transportation rack of FIG. 1 from another perspective with the construction equipment removed.

FIGS. 1 and 2 illustrate a first embodiment 110 of a transportation rack that includes a frame 120, a mesh base 130, a lifting device interface 140, a pair of inner brace members 150, and a plurality of supports 160 mounted to the frame 120. The frame 120 in the illustrated embodiment includes four sides (front side 171, rear side 172, right side 173, and left side 174) of equal length and therefore defines a square. In other embodiments, the frame 120 may take other geometric shapes, including, but not limited to a rectangle. The frame 120 is generally horizontal in its intended operational position, such that the frame 120 lies flat with the construction equipment supported above the frame 120.

The mesh base 130 fits within the frame 120 and defines a horizontal surface. The mesh base 130 provides some structural stability to the frame 120, and provides a surface on which relatively large items (i.e., large enough to not fall through the holes defined by the mesh) can rest if needed.

The lifting device interface 140 in the illustrated embodiment includes a pair of tubes 180 that are rectangular or square in cross-section and extend across the frame 120 between opposite sides (front and rear 171, 172 in the illustrated embodiment). The tubes 180 are rigidly mounted to the frame 120 as by welding or with fasteners. The tubes 180 are adapted to receive portions of a lifting device to facilitate loading and unloading the transportation rack onto and off of a transporter with the lifting device, as will be described below with reference to FIG. 9.

Figure 3:
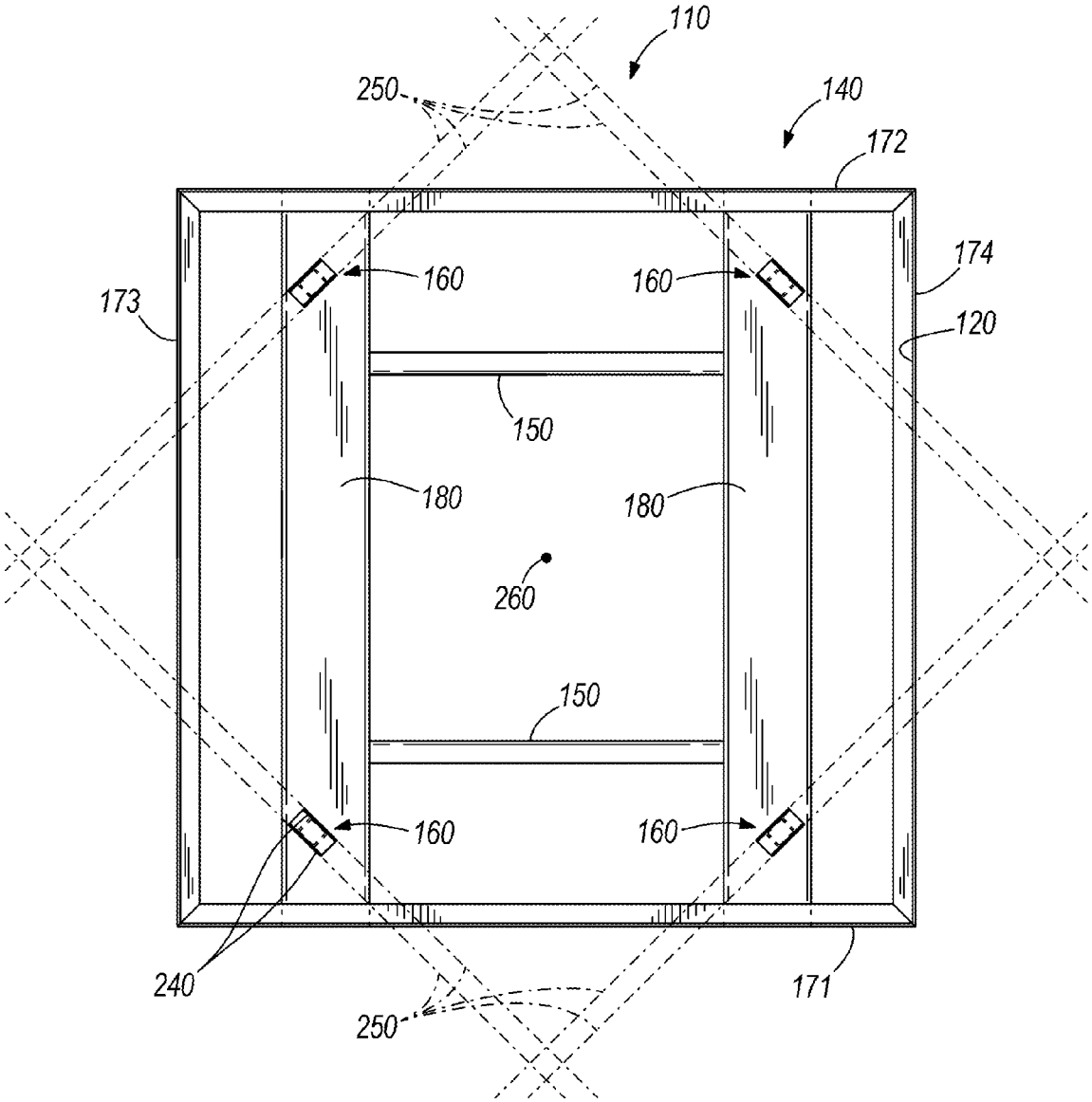
FIG. 3 is a top view of the transportation rack with the mesh base removed for illustrative purposes.

Referring now to FIG. 3, the inner braces 150 extend between the tubes 180 and are rigidly affixed to the tubes 180 as by welding or with fasteners. The inner braces 150 maintain the tubes 180 in a substantially parallel relationship. The tubes 180 and inner braces 150 structurally reinforce the frame 120 such that entire assembly is rigid.

Figure 5:
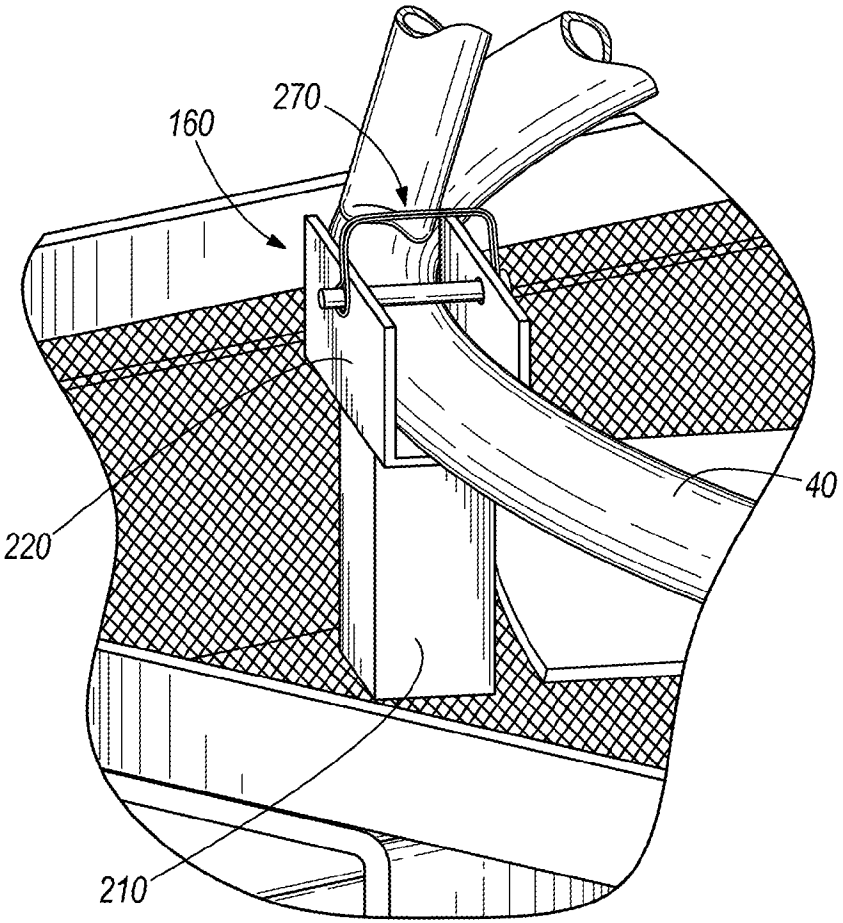
FIG. 5 is the same view as FIG. 4, with the piece of construction equipment received within the support.
Figure 4:
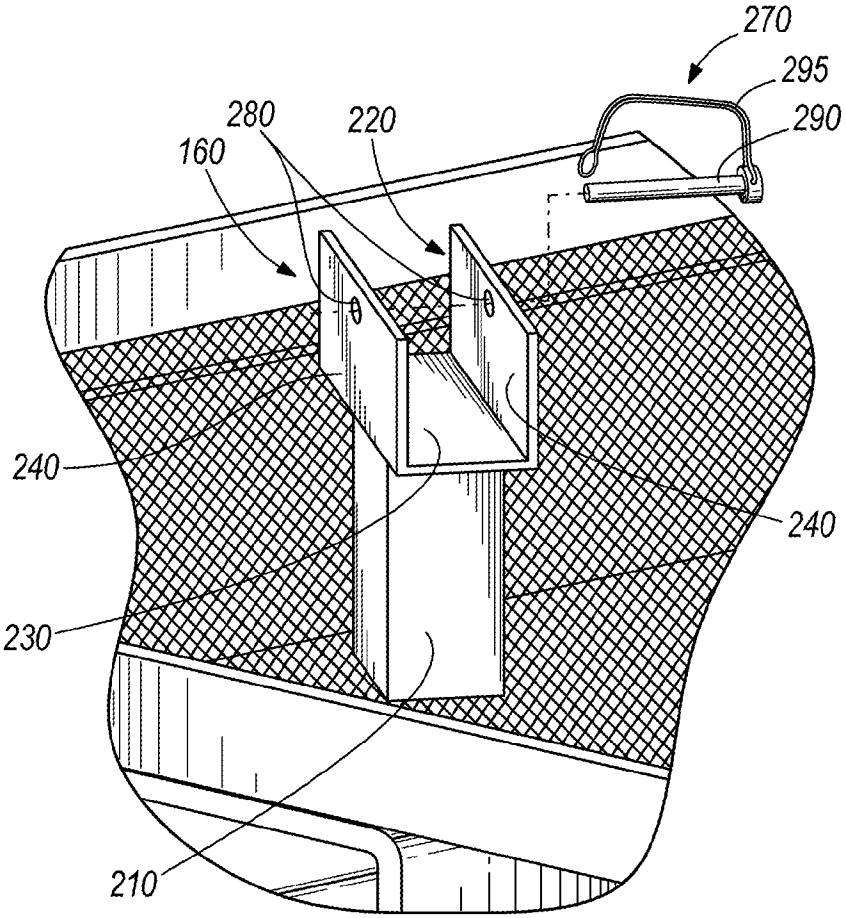
FIG. 4 is an enlarged view of one of the supports of the transportation rack.

With reference to FIGS. 4 and 5, each support 160 includes an upwardly-extending arm 210 and an upwardly-opening channel member 220. In the illustrated embodiment, the upwardly-extending arms 210 are welded or otherwise rigidly affixed to the tubes 180. The upwardly-extending arms 210 extend vertically in the illustrated embodiment. The channel members 220 are U-shaped, and have a bottom wall 230 and side walls 240 extending perpendicular to the bottom wall 230. In the illustrated embodiment, the bottom wall 230 is horizontal and the side walls 240 are vertical, such that the U-shaped channel member 220 may be said to open vertically. The bottom wall 230 and side walls 240 define a channel. For convenience, the terms "channel 220" will be used interchangeably with the term "channel member 220."

With reference to FIG. 3, the side walls 240 define vertical planes 250, and in the illustrated embodiment, the arrangement of vertical planes 250 is generally diamond shaped, with the diamond having a geometric center 260 roughly on the geometric center of the frame 120. The geometric center 260 of the diamond shape is estimated in the drawing for the purposes of illustration and should not be viewed as precise. Because the planes 250 defined by the side walls 240 are non-parallel and non-perpendicular to any of the sides 171, 172, 173, 174 of the frame 120, the channel members 220 may also be said to be non-parallel and non-perpendicular with respect to any of the sides 171, 172, 173, 174 of the frame 120.

Turning again to FIGS. 4 and 5, associated with each channel member 220 is a gate 270. The gate 270 is movable between an open position (FIG. 4) in which the gate 270 opens the channel member 220 to permit loading of a portion of the chassis into the channel member 220, and a closed position (FIG. 5) in which the gate 270 closes the channel member 220 to capture the portion of the chassis within the channel member 220 and limit vertical movement of the construction equipment with respect to the frame 120 during transport.

In the illustrated embodiment, the gate 270 includes a hole 280 in each of the side walls 240, a pin 290, and a latch 295. The holes 280 are aligned such that the pin 290 may be extended through one of the holes 280, across the channel 220, and through the hole 280 on the opposite side of the channel 220. The illustrated gate 270 is open when the pin 290 does not extend across the channel 220, and is closed when the pin 290 extends across the channel 220. The latch 295 is a piece of wire that is pivotally mounted to one end of the pin 290 (e.g., extends through holes in the head of the pin 290) and can be looped over the opposite end of the pin 290. When engaged, the latch 295 resists movement of the pin 290 out of the holes 280. The latch 295 reduces the likelihood that the gate 270 will open once the gate 270 is closed and latched.

In other embodiments, the gate 270 may take the form of a bar that is pivoted to one of the side walls 240 and pivots into a slot or other receptacle in the other side wall 240. For example, the bar might pivot about a vertical axis on one of the side walls 240 and be received within a horizontal slot in the other side wall 240 such that the bar extends across the channel 220.

Figure 7:
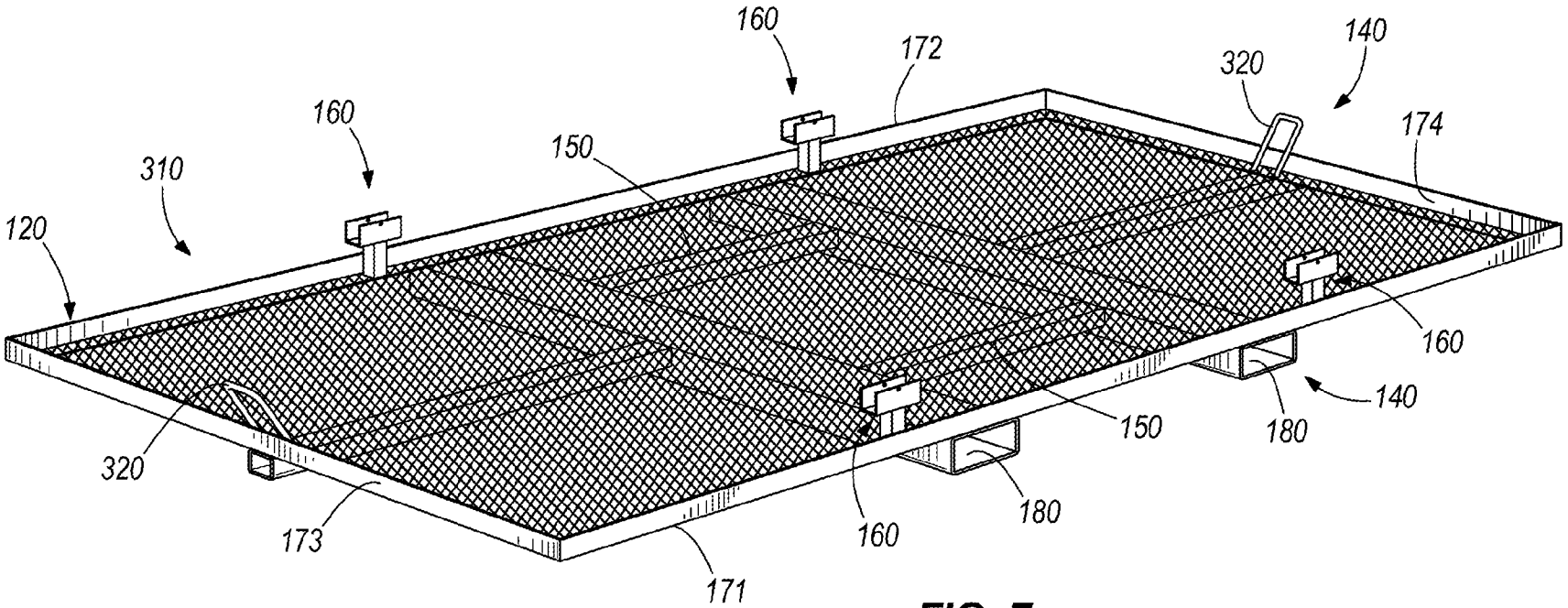
FIG. 7 is a perspective view of the transportation rack of FIG. 6 with the construction equipment removed.
Figure 8:
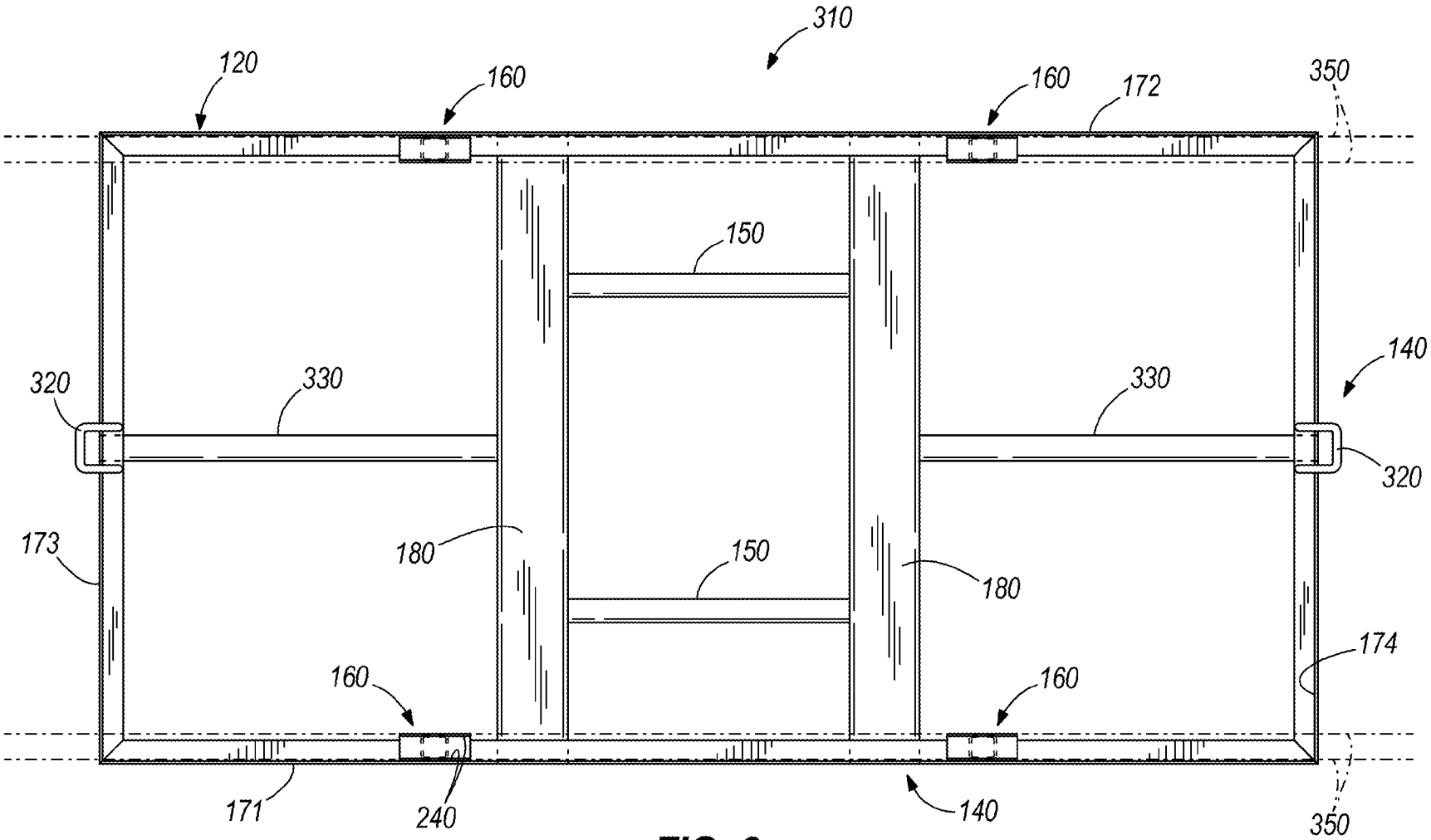
FIG. 8 is a top view of the transportation rack with the mesh base removed for illustrative purposes.

Turning now to FIGS. 6-8, a second embodiment 310 of the transportation system or transportation rack is similar to the first embodiment 110. The same reference numerals are used for the same or similar elements in this embodiment 310. This embodiment 310 is designed to support a larger piece of construction equipment, such as the illustrated ride-on trowel 20. The ride-on trowel 20 includes a seat 312 to accommodate a sitting operator. The bottom edge 40 of the skirt 30 of the ride-on trowel 20 includes straight portions 315 at the front and rear, and generally semi-circular curved portions 317 interconnecting the ends of the front and rear straight portions 315.

In this embodiment 310, the front and rear sides 171, 172 of the frame 120 are longer than the right and left sides 173, 174 of the frame 120, such that the frame 120 defines a rectangle. The pair of tubes 180 extend under the frame 120, between the front and rear sides 171, 172 of the frame 120. In this embodiment 310, the supports 160 are rigidly mounted to the front and rear sides 171, 172 of the frame 120.

In this embodiment 310, the lifting device interface 140 also includes handles or attachment anchors 320 rigidly mounted to the frame 120 at the midpoints of the right and left sides 173, 174. The attachment anchors 320 provide an interface for a person to grab and lift the rack 310 or for a lifting device, such as a hoist, to be attached.

With reference to FIG. 8, this embodiment of the transportation rack 310 also includes a pair of outer brace members 330 that are rigidly affixed to one of the tubes 180 and the right or left side 173, 174 of the frame 120. The outer brace members 330 extend between the midpoint of the sides 173, 174 of the frame 120 and the midpoint of each tube 180. The outer brace members 330 extend parallel to the inner brace members 150 and perpendicular to the tubes 180. The outer brace members 330 are collinear with each other in the illustrated embodiment and the line defined by the two outer brace members 330 is between the inner brace members 150.

In the second embodiment 310, the side walls 240 of the channel members 220 are parallel to the front and rear sides 171, 172 of the frame 120. The side walls 240 of the front channel members 220 define planes 350 are coplanar, as are the side walls 240 of the rear channel members 220.

In operation, the supports 160 in the illustrated embodiments 110, 310 receive the bottom edge 40 of skirt 30 and support the entire operational weight of the trowel 10, 20 such that the trowel blades 60 bear none of the operational weight during transportation of the construction equipment. The trowel blades 60 can be said to be suspended or to hang freely from the trowel 10, 20 while the trowel 10, 20 is supported by the supports 160. The channel members 220 limit horizontal movement of the construction equipment with respect to the frame 120 during transport. More specifically, horizontal movement of the bottom edge 40 of the skirt 30 is limited by the side walls 240 of the U-shaped channel members 220.

During loading of the trowel 10, 20 onto the transportation rack 110, 310, the pin 290 is removed from at least one of the holes 280 to open the channel member 220. The bottom edge 40 of the skirt 30 is inserted into the channel member 220, and then the pin 290 is extended through both holes 280 to close the channel member 220. The retaining wire 295 can then be attached to the free end of the pin 290 to retain the pin 290 in the holes 280. With the pin 290 in both holes 280 (i.e., the gate closed), the bottom edge 40 of the skirt 30 is captured within the channel member 220. Vertical movement of the construction equipment is limited by the bottom wall 230 and the gate 270 during transport. The walk-behind trowel 10 can be lifted manually or with a hoist onto the first embodiment 110 of the transportation rack, whereas most known ride-on trowels 20 include tubes for a fork lift to facilitate lifting the trowel 20 and depositing it onto the second embodiment 310 of the transportation rack.

The channel members 220 receive a curved portion of the chassis in the first embodiment 110. Indeed, the bottom edge 40 of the skirt 30 is circular so the entire edge 40 is curved. In the second embodiment 310, the channel members 220 receive the straight portions 315 of the bottom edge 40 of the skirt 30. The generally semi-circular curved portions 317 of the bottom edge 40 are not received within a channel member 220 or directly supported by a support 160.

With reference to FIG. 9, the transportation rack 110, 310 can be loaded on a transporter 410 for transportation of the construction equipment to a desired location. The term "transporter" is used to describe a truck bed or cargo area, a trailer to be towed by a truck, or any other motor vehicle or trailer that might be used to move construction equipment from one site to another.

The transportation rack 110, 310 is lifted with a lifting device 420, such as a forklift truck having a fork with a pair of arms. The arms of the forklift may be inserted into the tubes 180 so that the forklift can raise and lower the transportation rack 110, 310 and the construction equipment supported by the transportation rack 110, 310. Alternatively, a lifting device 420 such as a hoist having chains or cables can be attached to the attachment anchors 320 and lift the transportation rack 110, 310 onto the transporter 410.

Once on the transporter 410, the transportation rack 110, 310 can be secured to the transporter 410 without putting any load on the construction equipment. This is accomplished by lashing the frame 120 to the transporter 410, rather than lashing the construction equipment directly to the transporter 410. A securing load path is created by the lashing mechanism, and the construction equipment is outside of the securing load path. As a result, the construction equipment bears none of the securing load arising from lashing the rack 110, 310 to the transporter 410.

During transportation of the construction equipment, the rack 110, 310 and construction equipment are exposed to dynamic loading as the transporter 410 moves over uneven terrain. The dynamic loading is accommodated by the configuration of the supports 160. More specifically, the driven element 60 has an expected range of movement in response to the dynamic loading, and the supports 160 are made tall enough such that the driven element 60 does not bottom out against the mesh base 130 or any other portion of the rack 110, 310 within that expected range of motion. This protects the driven element 60 from potentially damaging impact loading. Additionally, the supports 160 are arranged such that the operational weight of the construction equipment is distributed evenly among the plurality of supports 160.

Thus, the invention provides, among other things, a transportation system for transporting construction equipment that rides on a driven element during ordinary operation. The transportation system relieves a portion or all of the operational weight of the construction equipment from the driven element during transportation of the construction equipment. Various features and advantages of the invention are set forth in the following claims.

What is claimed is:

1. A transportation system comprising:

construction equipment that includes a chassis, a prime mover supported by the chassis, and a driven element, the construction equipment having an operational weight that is borne by the driven element during ordinary operation of the construction equipment, the driven element adapted to be actuated under the influence of the prime mover during operation of the construction equipment to perform work;

a frame; and a plurality of supports mounted to the frame, the supports adapted to receive a portion of the construction equipment chassis and support at least a portion of the operational weight;

wherein the transportation system is adapted to be loaded on a transporter for transportation of the construction equipment.

2. The transportation system of claim 1, wherein the frame is generally horizontal; and wherein each of the supports extends upwardly.

3. The transportation system of claim 1, wherein the supports support the entire operational weight such that the driven element bears none of the operational weight during transportation.

4. The transportation system of claim 1, wherein each support includes a channel member that opens upwardly to receive a portion of the construction equipment chassis; wherein the channel members support the construction equipment and limit horizontal movement of the construction equipment with respect to the frame during transport.

5. The transportation system of claim 4, wherein the channel members are generally U-shaped.

6. The transportation system of claim 4, further comprising a gate associated with each channel member, the gate being movable between an open position in which the gate opens the channel member to permit loading of a portion of the chassis into the channel member, and a closed position in which the gate closes the channel member to capture the portion of the chassis member within the channel member and limit vertical movement of the construction equipment with respect to the frame during transport.

7. The transportation system of claim 4, wherein each channel member includes a pair of holes; the transportation system further comprising a pin removable from at least one of the holes to open the channel member to permit loading of a portion of the chassis into the channel member, and insertable into both holes to close the channel member to capture the portion of the chassis member within the channel member and limit vertical movement of the construction equipment with respect to the frame during transport.

8. The transportation system of claim 1, further comprising a lifting device interface mounted to the frame and adapted to receive portions of a lifting device to facilitate loading and unloading the transportation system onto and off of the transporter with the lifting device.

9. The transportation system of claim 1, further comprising:

a pair of tubes extending under the frame, the tubes being rigidly affixed to the frame and facilitating lifting of the transportation system with a lifting device;

at least one inner brace member rigidly affixed to each of the tubes; and at least one outer brace member rigidly affixed to one of the tubes and to the frame.

10. A method of transporting construction equipment, comprising:

providing construction equipment that includes a chassis, a prime mover supported by the chassis, and a driven element, the construction equipment having an operational weight that is borne by the driven element during ordinary operation of the construction equipment, the driven element adapted to be actuated under the influence of the prime mover during operation of the construction equipment to perform work;

providing a transportation rack that includes a frame and a plurality of supports mounted to the frame;

positioning the construction equipment on the rack with each of the supports receiving a portion of the construction equipment chassis;

bearing with the supports at least a portion of the operational weight;

loading the rack bearing the construction equipment on a transporter for transportation of the construction equipment; and transporting the construction equipment with the transporter to a desired location.

11. The method of claim 10, wherein providing a transportation rack includes extending the supports upwardly from the frame.

12. The method of claim 10, wherein bearing at least a portion of the operational weight includes bearing the entire operational weight such that the driven element bears none of the operational weight during transportation.

13. The method of claim 10, further comprising generating dynamic loading on the rack and construction equipment in response to transporting the construction equipment; and accommodating with the configuration of the supports an expected range of movement of the driven element in response to the dynamic loading to protect the driven element from potentially damaging impact loading.

14. The method of claim 10, wherein providing a transportation rack includes providing a channel member as part of each support, each channel member opening upwardly to receive a portion of the chassis; wherein positioning the construction equipment on the rack includes positioning a portion of the chassis in each of the channel members; and wherein transporting the construction equipment includes resisting with the channel members horizontal movement of the construction equipment with respect to the frame.

15. The method of claim 10, wherein providing a transportation rack includes providing a gate associated with each channel member; wherein positioning the construction equipment on the rack includes moving the gate into an open position to permit loading of a portion of the chassis into the channel member and moving the gate into a closed position to capture the portion of the chassis member within the channel member; and wherein moving the gate into a closed position includes resisting with the gate horizontal vertical movement of the construction equipment with respect to the frame.

16. The method of claim 10, wherein providing a transportation rack includes mounting a lifting device interface to the frame; and wherein loading the rack bearing the construction equipment on a transporter includes engaging the lifting device interface with a lifting device and loading the rack and construction equipment onto the transporter with the lifting device.

17. A method of transporting a power trowel, comprising:

providing a power trowel that includes a chassis, a prime mover supported by the chassis, and plurality of trowel blades, the power trowel having an operational weight that is borne by the trowel blades during ordinary operation of the construction equipment, the trowel blades adapted to be actuated under the influence of the prime mover during operation of the power trowel to smooth concrete;

providing a transportation rack that includes a frame and a plurality of supports mounted to the frame;

positioning the power trowel on the rack with each of the supports receiving a portion of the chassis;

bearing with the supports at least a portion of the operational weight such that such portion of the operational weight is not borne by the trowel blades;

loading the rack bearing the power trowel on a transporter; and transporting the power trowel with the transporter to a desired location.

18. The method of claim 17, wherein providing a power trowel includes providing a power trowel with a chassis that includes a skirt having a bottom edge, the trowel blades rotating below the skirt under the influence of the prime mover; and wherein positioning the construction equipment on the rack includes resting the bottom edge on the supports.

19. The method of claim 18, wherein providing a power trowel includes providing a walk-behind trowel, a portion of the chassis defining a circular bottom edge around the trowel blades; wherein providing a transportation rack includes arranging the supports in a circular configuration; and wherein positioning the construction equipment on the rack includes resting the circular bottom edge on the supports.

20. The method of claim 18, wherein providing a power trowel includes providing a ride-on trowel having multiple sets of trowel blades, a portion of the chassis defining multiple curved portions; wherein providing a transportation rack includes arranging the supports in a configuration that mirrors the multiple curved portions; and wherein positioning the construction equipment on the rack includes resting the multiple curved portions on the supports.

21. The method of claim 17, wherein bearing at least a portion of the operational weight includes distributing the borne operational weight evenly among the plurality of supports.

22. The method of claim 17, further comprising providing a securing apparatus; securing the frame to the transporter with the securing apparatus by applying a securing load to the frame a long a load path; and positioning the power trowel outside of the load path such that the power trowel bears none of the securing load.

* * * * *